US007472484B2

(12) United States Patent
Smilanich

(10) Patent No.: US 7,472,484 B2
(45) Date of Patent: Jan. 6, 2009

(54) UNIVERSAL OUTDOORSMAN TOOL

(76) Inventor: Dan Jeffrey Smilanich, P.O. Box 12622, Jacksonville, NC (US) 28546

( * ) Notice: Subject to any disclaimer, the term of this patent is extended or adjusted under 35 U.S.C. 154(b) by 29 days.

(21) Appl. No.: 10/958,042

(22) Filed: Oct. 5, 2004

(65) Prior Publication Data

US 2006/0070247 A1 Apr. 6, 2006

(51) Int. Cl.
*B26B 23/00* (2006.01)

(52) U.S. Cl. ..... 30/308.1

(58) Field of Classification Search ..... 30/308, 30/308.1, 308.2, 308.3, 164.5, 314; 7/145; D8/75, 76, 36, 98; D22/118; 81/19–22
See application file for complete search history.

(56) References Cited

U.S. PATENT DOCUMENTS

| | | | | | |
|---|---|---|---|---|---|
| 111,024 | A | * | 1/1871 | White | 30/314 |
| 189,196 | A | * | 4/1877 | Crawford | 7/145 |
| 745,162 | A | * | 11/1903 | Donnelly | 30/308 |
| 776,734 | A | * | 12/1904 | Fuller | 30/308.1 |
| 1,030,429 | A | * | 6/1912 | Reeves | 30/308.1 |
| 1,265,276 | A | * | 5/1918 | Stephens | 30/308.1 |
| D56,010 | S | * | 8/1920 | Lickert | 30/308 |
| 1,348,920 | A | * | 8/1920 | Young | 30/308.1 |
| D67,749 | S | * | 7/1925 | Faust | 7/145 |
| 1,562,154 | A | * | 11/1925 | Erickson | 30/314 |
| 1,679,814 | A | * | 8/1928 | Cicero | 7/159 |
| D94,945 | S | * | 3/1935 | Burdge | 30/308 |
| D120,609 | S | * | 5/1940 | Arnsbarger | D8/76 |
| D145,004 | S | * | 6/1946 | Browne et al. | D8/DIG. 3 |
| D164,311 | S | * | 8/1951 | Mills | 30/308 |
| 2,611,181 | A | * | 9/1952 | Coulter | 30/308 |
| 2,989,100 | A | * | 6/1961 | Burdis et al. | 30/308.2 |
| 3,187,354 | A | * | 6/1965 | Frisbie | 30/308.3 |
| D203,575 | S | * | 1/1966 | Dobbs | D8/76 |
| D212,579 | S | * | 10/1968 | Hefner | D8/76 |

(Continued)

FOREIGN PATENT DOCUMENTS

EP 1101569 A2 * 5/2001

(Continued)

OTHER PUBLICATIONS

Lee Valley & veritas ® Fine Woodworking Tools, 2001, pp. 132-133.*

*Primary Examiner*—Jason Daniel Prone
(74) *Attorney, Agent, or Firm*—The Rudy Law Firm; William T. Helwig

(57) ABSTRACT

A single universal tool for the outdoorsman, combining a multi-edged tool head with a multi-grip tool handle, which allows for separate and specific use of each portion of the tool head, depending on the portion of the handle gripped and the tool edge to be used. It is a one-piece unit that has a long-handled hatchet like appearance, with a hatchet/cleaver blade that extends into a curved knife-tip with upper and lower sharpened edges, and a spiky edge opposite the main blade. The handle attaches to the tool head as a curved, finger-notched, pistol style grip, for control while wielding as a cleaver or knife, then extending into an elongated handle for developing power when wielded as a hatchet. A combination knife, meat cleaver, hatchet, along with other uses. A fore finger hole is located in the tool head inline with the handle, for more precise control of the knife-tip.

2 Claims, 1 Drawing Sheet

Figure 1:
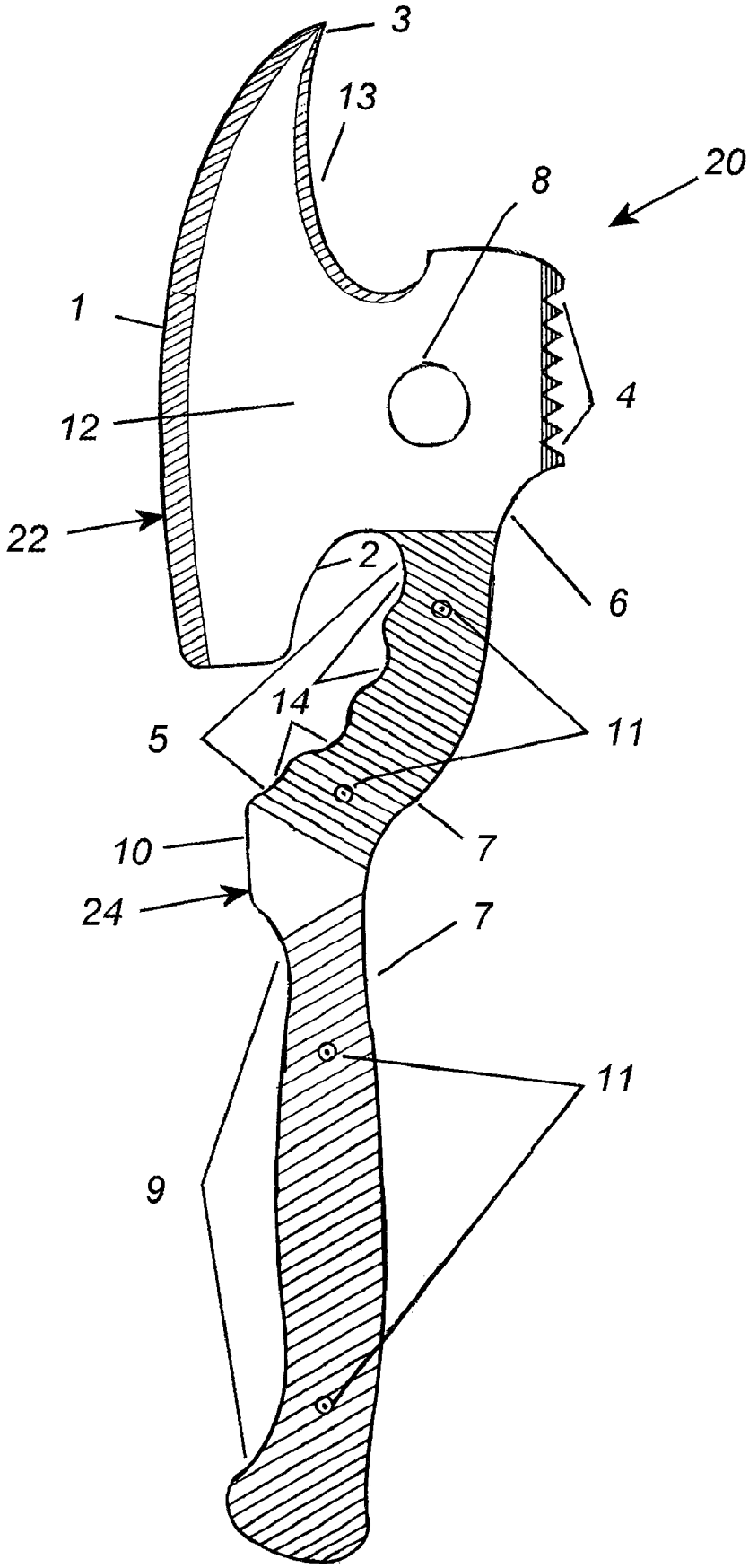

U.S. PATENT DOCUMENTS 4,154,273 A * 5/1979 Pollak ..... 81/20
D266,903 S * 11/1982 Tarran ..... D8/76
D270,654 S * 9/1983 Barrett ..... D8/76
4,481,689 A * 11/1984 Westmoreland ..... 30/169
4,546,510 A * 10/1985 Harrison ..... 7/145
4,548,248 A * 10/1985 Riemann ..... 81/22
D299,414 S * 1/1989 Bajza et al. ..... D8/76
4,817,221 A * 4/1989 Ryan ..... 30/308.3
4,958,540 A * 9/1990 Davis ..... 81/20
D322,019 S * 12/1991 Cox ..... D8/76
D329,366 S * 9/1992 Ragoonath ..... D8/76
5,261,164 A * 11/1993 Bellegante ..... 30/308.1
D370,398 S * 6/1996 Juranitch ..... D8/76
D382,187 S * 8/1997 Hibben ..... D8/76
5,692,308 A * 12/1997 Di Libero ..... 30/308
5,906,144 A * 5/1999 Staviski et al. ..... 81/20
6,079,071 A * 6/2000 Sablan et al. ..... 30/155
D464,549 S * 10/2002 Sloan ..... D8/76
6,568,016 B1 * 5/2003 Hoogland ..... 7/145
D486,202 S * 2/2004 Rae et al. ..... D22/118
D528,394 S * 9/2006 Lothe ..... D8/76
2004/0244545 A1 * 12/2004 Stinnissen et al. ..... 7/145

FOREIGN PATENT DOCUMENTS

WO WO 2004073934 A1 * 9/2004

* cited by examiner

UNIVERSAL OUTDOORSMAN TOOL

CROSS REFERENCE

Not Applicable

BACKGROUND OF THE INVENTION

The invention relates to a universal outdoorsman tool, and specifically to a universal outdoorsman tool combining a multi-edged tool head with a multi-grip tool handle, allowing for separate and specific use of each portion of the tool head, depending on the portion of the handle gripped and the tool edge to be used. The typical outdoorsman makes use of several different tools required for various activities associated with hunting, trapping, fishing, and camping while exploring the wild. To accomplish tasks associated with these activities presents the need of changing from tool to tool. It is desired to have a tool that is designed with various features combined into one body template, which can be used in performing different cutting, chopping, skinning, and crushing techniques associated with hunting, fishing, and including, but not limited to camping. It is the purpose of the present invention to provide these features in a single universal outdoorsman tool. Further objects and advantages will become apparent from a consideration of the following description and drawings.

SUMMARY OF THE INVENTION

A single universal tool for the outdoorsman, combining a multi-edged tool head with a multi-grip tool handle, which allows for separate and specific use of each portion of the tool head, depending on the portion of the handle gripped and the tool edge to be used, without switching between tools. A combination knife, meat cleaver and hatchet, along with other uses. With this universal tool, there is no need to carry many tools because they are all in one, which also makes for a lighter load. It is a one-piece unit that has a long-handled hatchet like appearance, with a hatchet/cleaver blade that extends into a curved knife-tip with upper and lower sharpened edges, and a spiky edge opposite the main blade. The handle attaches to the tool head as a curved, finger-notched, pistol style grip, for control while wielding as a cleaver or knife, then extending into an elongated handle for developing power when wielded as a hatchet. A fore finger hole is located in the tool head inline with the handle, for more precise control of the knife-tip. All the tool requires is a changing of direction in the hand at the handle, grip, or fore finger/hanger hole. To care for the item never requires cleaning separate or many tools, there is just one tool to clean. The features of the present invention are made obvious to those of ordinary skill in the art after reading of the following description of the universal hunting tool.

BRIEF DESCRIPTION OF THE DRAWING FIGURES

The present invention may be understood from the description of the preferred embodiment which follows and from the accompanying drawing. The drawing is hereby expressly made a part of the specification.

FIG. 1 is a side view of the Universal Outdoorsman Tool.

DETAILED DESCRIPTION

Reference is made herein to the attached drawing. For the purpose of presenting a brief and clear discussion of the universal outdoorsman tool, the preferred embodiment, which is depicted in a vertical arrangement, will also be discussed directionally as if held for use in a vertical manner with the hatchet blade facing forwards. Therefore, in the following description, terms such as lower and upper and the like are used solely for the purpose of clarity in illustrating and describing the invention when so held. This is for representative purposes only and should not be construed as limiting in any manner.

Referring now to FIG. 1, the preferred embodiment of the universal outdoorsman tool, is seen from a side view. The invention as described is a tool 20 incorporating a tool head portion 22, and a handle portion 24.

The tool head 22 includes a steel surface face 12, a hatchet/cleaver convex blade edge 1, a first concave surface with a knife blade 13, wherein the convex blade edge 1 and the first concave surface with a knife blade 13 intersect to form a knife tip 3, a second concave surface 2 on a side of the tool head 22 opposite the first concave surface with a knife blade 13, a spiky edge 4 on a side of the tool head 22 opposite the convex blade edge 1, a thumb rest curve 6 extending from the spiky edge 4, and a hole 8 adjacent the spiky edge.

The handle portion 24 extends from the curved thumb rest 6 and the second concave surface 2. The handle portion 24 includes a curved upper portion 5 and a substantially linear elongated lower portion 9 connected to the upper portion 5 by a flat-sided intermediate heel 10. The curved upper portion 5 curves away from the spiky edge and towards the convex blade edge 1 thereby mimicking the style of a pistol grip. The upper portion further includes finger notches 14 to engage the user's fingers. The upper portion 5 and the lower portion 9 are both covered with grip covers 7 that are riveted or screwed to the individual handle portions 11.

More specifically, the curved upper portion 5 of the handle 24, curves forward, from its generally vertical orientation at its attachment to the base of the tool head 22, at an angle from vertical where it ends at the forward facing flat sided intermediate heel 10, and notwithstanding the finger notches 14, running the length of the front edge of the upper portion 5, the front and rear edges of the upper portion 5 are generally parallel, and the width of the upper portion 5 between its front and rear edges is generally uniform, as can be clearly seen in the drawing FIGURE. The forward facing flat sided intermediate heel 10, as can be seen at the base of the curved upper portion 5, is generally vertical in orientation and generally parallel in alignment with the convex blade edge 1 and the substantially linear elongated lower portion 9 of the handle 24. The lower portion 9 is then also generally vertical in orientation and generally parallel in alignment with the convex blade edge 1, and also generally parallel in alignment with the intermediate heel 10 to which it is connected and extends from, and is therefore not in vertical alignment with the attachment of the upper portion 5 of the handle 24 to the base of the tool head 22, being offset forward by the forward curving upper portion 5, being then generally in vertical alignment with the second concave surface 2 on the bottom of the tool head 22.

The hole 8, provides for the natural placement of the forefinger for accurate usage of the knife tip 3, the convex blade edge 1, and the concave surface with a knife blade 13, when the tool 20 is used for regular knife usage, trimming, and skinning, and may also serve as a hook hanger hole. The hatchet/cleaver convex blade edge 1 is used for wood chopping, and meat cleaning. The concave surface with a knife blade 13 is used for the purpose of rope cutting and field dressing. The spiky edge 4 is used for bone cracking, meat tenderizing, and fish scaling. The grip covers 7 are a riveted or screwed on surface that can be made of wood, bone, or aluminum cast that is attached with (2) rivets or screws 11 (Although the aluminum is recommended, it is not required). The intermediate heel 10 provides an approximation of at least 1" of smooth transition between the upper portion 5 and lower portion 9 areas of the tool handle 24. The finger notched 14 curved upper portion 5 of the tool handle 24 provides a very controlled grip on the handle and is used for gripping in order to control usage of the convex hatchet/cleaver blade edge 1 when used as a meat cleaver as well as controlling usage of the knife tip 3 and edges 1 and 13 when the tool 20 is used for regular knife usage. The finger notched 14 curved upper portion 5 of the tool handle 24 is also used for lightweight wood chopping or wood shaving when using the convex hatchet/cleaver blade edge 1. The substantially linear elongated lower portion 9 of the tool handle 24 provides a very powerful grip on the handle and is used for extra wood chopping, meat chopping, and bone cracking power.

I claim:

1. A universal outdoorsman tool comprising:

a multi-edged tool head and a multi-grip tool handle;

said tool head comprising a hatchet/cleaver convex blade edge, a concave knife blade edge, said concave knife blade edge and said convex blade edge intersect to form a knife tip, a concave surface on a side of said tool head opposite said concave knife blade edge, a spiky edge on a side of said tool head opposite said convex blade edge, a thumb rest curve extending from said spiky edge, and a hole located adjacent to the spiky edge; and said handle extending from said thumb rest curve and said concave surface; said handle including a curved upper portion and a substantially linear elongated lower portion, said upper portion having curved front and rear edges which are generally parallel in orientation, and which curve away from said spiky edge and towards a plane defined by said convex blade edge, ending in a forward facing flat sided intermediate heel, said lower portion is generally vertical in orientation and generally parallel in alignment with the convex blade edge, and vertical in alignment forward of a top portion of said front edge of said upper portion, and is connected to the upper portion by said intermediate heel, said heel being generally parallel in alignment with said lower portion, and said curved upper portion includes at least four finger notches running a length of said curved front edge, without which a width of said upper portion between the front and rear edges is generally uniform.

2. The universal outdoorsman tool according to claim 1, wherein said handle is further comprised of handle covers riveted or screwed to the upper portion and the lower portion thereof.

* * * * *